United States Patent [19]

Hall

[11] Patent Number: 4,804,136

[45] Date of Patent: Feb. 14, 1989

[54] CONTAINER

[75] Inventor: William E. Hall, Palatine, Ill.

[73] Assignee: Grafcor Packaging Inc., Elk Grove Village, Ill.

[21] Appl. No.: 106,513

[22] Filed: Oct. 7, 1987

[51] Int. Cl.[4] ..... B65D 5/20

[52] U.S. Cl. ..... 229/112; 229/120; 229/126; 229/906; 229/DIG. 14

[58] Field of Search ..... 229/112, 120, 126, 906, 229/DIG. 14, 16 C, 148, 40, 6 R, 16 R

[56] References Cited

U.S. PATENT DOCUMENTS

| | | | |
|---|---|---|---|
| 963,313 | 7/1910 | Nack . | |
| 1,141,076 | 5/1915 | Shapiro | 229/112 |
| 1,152,145 | 8/1915 | Collins | 229/16 R |
| 2,135,140 | 11/1938 | Magers . | |
| 2,179,081 | 11/1939 | Bench, Jr. . | |
| 2,333,244 | 11/1943 | Gordon | 229/120 |
| 3,184,136 | 5/1965 | Forbes, Jr. | 229/148 |
| 3,219,256 | 11/1965 | Zastrow . | |
| 3,252,650 | 5/1966 | Pryor . | |
| 3,361,329 | 1/1968 | Fox | 229/112 |
| 3,524,580 | 8/1970 | Heyworth | 229/40 |
| 3,623,650 | 11/1971 | Watts . | |
| 4,245,773 | 1/1981 | Stollberg . | |
| 4,304,353 | 12/1981 | Stollberg | 229/120 |

*Primary Examiner*—Stephen Marcus
*Assistant Examiner*—Gary E. Elkins
*Attorney, Agent, or Firm*—Aubrey L. Burgess; Henry S. Layton

[57] ABSTRACT

A carton having a bottom, end and side walls, and a two part top, the top having slots receiving locking tabs on the side walls for maintaining an interlocking slotted relationship therebetween. The bottom, side and end walls and top parts are integral, formed of one piece of material with the top parts and end walls wider than the width of the bottom, so as to overlie and be supported by the side walls.

6 Claims, 1 Drawing Sheet

FIG. 1
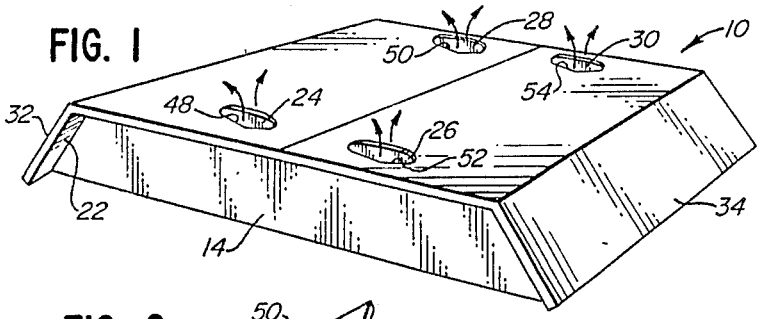
FIG. 2
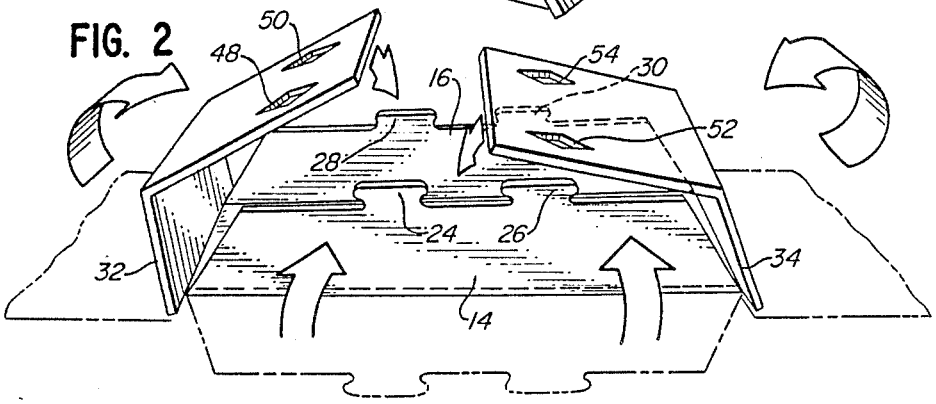
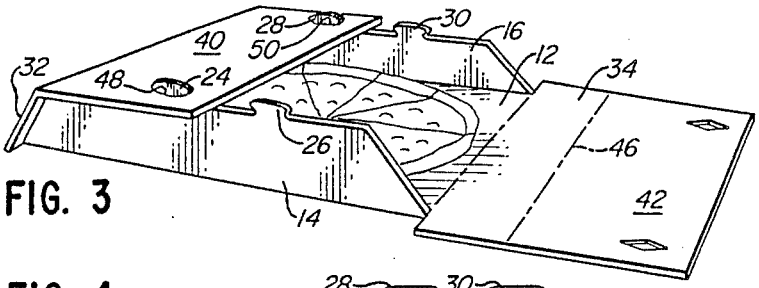
FIG. 3
FIG. 4
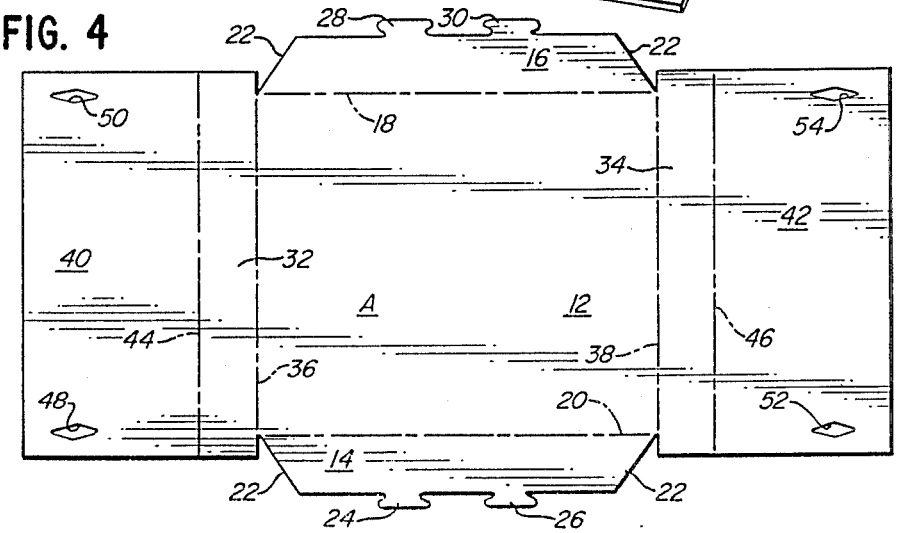

CONTAINER

FIELD OF THE INVENTION

This invention relates to containers, such as those constructed of corrugated cardboard and the like.

BACKGROUND OF THE INVENTION

Containers constructed from a single sheet of corrugated cardboard and folded into a box form are well know in the art. Thousands of such boxes are used daily to provide take home containers for such foods as pizzas, after which the containers are discarded. These boxes may be formed to keep the food, such as pizzas, relatively hot for consumption. Usually vents are provided to permit steam, which would affect the taste and texture of the contained food, to escape.

Boxes for pizza are usually "assembled" as they are needed. One known form of such a box comprises a bottom, side and end walls and a top, the side and end walls being joined to the bottom by fold lines. The top is joined to an end wall at a fold line and has front and side closure flaps joined thereto by fold lines. The other and front end wall is joined to a secondary end wall at a fold line, the secondary end wall having small tabs along its free edge which register with slots at the fold line between the bottom and the end wall to thus form a double thickness front wall. The side walls are provided with tongues joined at their ends by fold lines, which tongues extend lengthwise from the side walls.

When assembling a container from a blank, the side walls are folded upwardly so as to be generally normal to the bottom, the tongues are folded to extend along the fold lines of the end members, the end wall with the connected secondary wall is folded upwardly and the secondary wall is folded into the box, over the tongues and with its tabs registering with the slots to form the double thickness front. The opposite end wall is folded at the bottom, so as to be generally normal thereto and with the other tongues inwardly of the container. The edge flaps of the top are folded and inserted into the box like assembly. Before the top is closed, the contents or product is placed onto the bottom of the container.

THE PRIOR ART

Pryor in U.S. Pat. No. 3,252,650, discloses a folding carton constructed of a single square of material comprising a rectangular bottom panel with fold lines at its longer and shorter sides. Relatively narrow side panels are integrally connected to the bottom panel along the fold lines, and triangular top panels are connected to the side panels along fold lines. In use, after an article or product is placed upon the bottom panel, the smaller top panels are folded over the product until their edges abut. Because of the size of the smaller panels, the side panels to which they are connected become acutely angled with respect to the bottom panel. The larger top panels are then folded toward one another until their edges abut and they are glued or stapled to the smaller top panels. The side panels to which the larger top panels are connected become acutely angled with respect to the bottom panel.

Watts, in U.S. Pat. No. 3,623,650, discloses a carton having a bottom wall, a plurality of vertical side walls and a top wall foldably connected to one of the side walls. The top wall has extension flaps foldably connected thereto which are held against the exterior top portions of associated side walls by a plurality of tabs extending from the top edges of the side walls and cooperating fastening tongues defined by non-rectilinear cuts in the top wall.

Stollberg, in U.S. Pat. No. 4,245,773, discloses a container comprising a bottom, side wall panels and side walls connected at fold lines to the bottom, top flaps connected to opposite side walls at fold lines and inner side wall panels connected at fold lines to the opposite side walls to which the top flaps are connected. The inner side wall panels have extending tabs which, when the blank is folded, extend through slots in the top flaps. The inner side wall panels are glued to the side wall panels.

BRIEF DESCRIPTION OF THE INVENTION

The carton of this invention comprises a generally rectangular bottom, a top, opposite end walls and opposite side walls, the ends of the side walls being angled, such that the side walls define an isosceles trapezoid. The end and side walls space the top from the bottom when the carton is assembled. Generally the blank from which the carton is formed is cut from a single sheet of material. Of course, the blank could be formed by joining various parts together, but this procedure is not economical.

The top is to two generally equal parts. The opposite end walls are each integral along fold lines with the bottom, and when folded, define an acute angle with the bottom and a supplementary angle with the top. The opposite side walls are also integral along fold lines with the bottom, and when folded, are generally normal to the bottom and to the top. The ends of the side walls are angled, such that the side walls define an isosceles trapezoid. The opposite side walls are provided with extending locking tabs which are adapted to be received in generally elongated and diamond shaped slots in the top parts. The top parts and the end walls are wider that the bottom at the fold lines, so as to extend beyond the side walls. Thus the side walls provide relatively rigid support for the top parts when the container is assembled. When the carton is assembled, the top parts preferably abut one another at their free ends, usually centrally of the carton; however, some overlap of the top parts can be provided if desired by increasing the length of one or both of the top parts.

For a given size carton, the carton of this invention uses less material for its manufacture than the conventional carton described herein; also, because of this, the carton of this invention is less costly to manufacture, for example on the order of 15% or more. Not only is the carton of this invention less costly to manufacture, but considerable savings of labor in assembling and filling the carton with its product or goods can be achieved by its use.

In use, one folds the side walls upwardly, folds one end wall upwardly and folds the connected top over the side walls with locking tabs of the side walls registering with and passing through slots in the top part, providing an interlocking connection between the parts. The carton can now be filled with its product after which the opposite end wall is folded upwardly and the connected top part is folded over the side walls with locking tabs registering with and passing through slots in the top part providing an interlocking connection between the parts. The slots are generally elongated and diamond shaped and provide openings functioning as vents for the escape of steam.

The carton of this invention finds particular use in packaging pizzas as sold by carry-out pizza parlors. To remove the product, it is only necessary to unfold one of the two top parts. The space required for the carton on a table surface equals the area of the bottom plus the area of one half the top plus that of the end wall. This is far less than that required for the conventional carton before described—an area equal to the entire top plus the bottom plus a wall.

BRIEF DESCRIPTION OF THE DRAWING

FIG. 1 is an isometric illustration of a carton constructed according to this invention;

FIG. 2 is an illustration of the procedure for assembling the carton of FIG. 1 from a blank;

FIG. 3 is an illustration of the manner of filling the carton or removing its contents; and FIG. 4 is a plan view of a blank from which the carton of FIG. 1 is assembled.

DETAILED DESCRIPTION OF THE PREFERRED EMBODIMENTS

As illustrated in the drawing, the carton 10 of this invention is preferably formed from a blank A (see FIG. 4) die cut from a single piece or sheet of material, such as corrugated cardboard and the like. The carton 10 comprises a generally rectangular bottom 12 with side walls 14 and 16 integral therewith at fold lines 18 and 20, the side walls 14 and 16 being angled as at 22 at their ends. Each side wall is substantially identical and is provided with a pair of spaced locking tabs 24, 26, 28 and 30, as the case may be, extending therefrom and integral therewith.

Generally rectangular end walls 32 and 34 are integral with the bottom 12 at fold lines 36 and 38, respectively, and top parts 40 and 42 at fold lines 44 and 46. The end walls 32 and 34 are substantially equal in size and shape and the top parts 40 and 42 are usually substantially equal is size and shape. The end walls 32 and 34 and the top parts 40 and 42 are wider than the bottom 12 at the fold lines 36 and 38, and each top part 40 and 42 is formed with slots 48 and 50, and 52 and 54, so as to register with the locking tabs 24 and 26, and 28 and 30 extending from the side walls 14 and 16. The slots 48, 50, 52 and 54 are preferably elongated and diamond shaped to provide not only for the passage of the locking tabs, but also to function as vents for the escape of steam, when present.

In use, the side walls 14 and 16 are folded upwardly along the fold lines 18 and 20, one end wall 32 is folded upwardly along fold line 36, so as to rest on the angled ends 22 and the top part 40 connected to the folded end wall 32 is folded down along fold line 44 onto the side walls. A pair of locking tabs 24 and 26 are registered with and passed through a pair of slots 48 and 50 to provide an interlocking slotted connection of the top part 40 and the remainder of the container. The carton 10 is now ready to receive its product (or have its contents removed). After placing the product in the partly assembled carton, the other end wall 34 is folded upwardly along fold line 38 over the angled part 22 of the side walls 14 and 16 and the top part 42 is folded along fold line 46 over the side walls 14 and 16. The locking tabs 26 and 30 are registered with and passed through a pair of slots 52 and 54 to provide the interlocking slotted connection of the top part 40 to the container.

The assembled carton 10 is relatively rigid, at least equalling the rigidity of the prior carton before described, but because less mateial is used to manufacture the blanks for the carton of this invention, the carton 10 is lighter in weight than the prior art carton.

To remove the product, only one top part (either 40 or 42) need be unlocked from the locking tabs and unfolded, permitting the product to be removed from the carton.

The improved carton of this invention for a given size is substantially less expensive to manufacture, uses less material, is less in weight, and requires less labor to assemble and fill. The savings can be of the magnitude of 15% or more when compared to the costs for the conventional carton without sacrificing rigidity of the carton.

The appended claims are intended to cover all reasonable equivalents and are to be interpreted as the prior art will permit.

I claim:

1. A corrugated cardboard box comprising:

a bottom;

a two part top overlying the bottom and spaced therefrom, each part being rectangular and substantially adjacent to one another along an edge, each part being substantially equal in size and shape;

a pair of parallel walls, each having one edge foldably attached to an opposite side of the bottom and adapted to be folded upwardly so as to be generally perpendicular to the bottom;

a pair of opposite wall sections each attached to an opposite side of said bottom and to a part of said top;

upstanding locking tabs integral with each of said parallel walls, said parallel walls having portions free of locking tabs;

slot means in each part of said top, so as to each register with one of said tabs when the top parts overlie the bottom to hold the top parts in interlocking slotted relationship with said parallel walls, said portions of said parallel walls free of tabs supporting said top parts in spaced relationship to said bottom;

each slot means being elongated and diamond shaped and each locking tab having an extended portion.

2. A box as recited in claim 1, in which said parallel walls and wall sections are formed of a single sheet of material.

3. A box as recited in claim 2, in which said wall sections and top parts are wider than the parallel walls and said bottom.

4. A box as recited in claim 3, in which said side walls each define an isosceles trapezoid.

5. A foldable carton comprising:

a generally rectangular bottom;

a top of two parts, each part being of substantially equal size and shape and each being defined by an edge;

opposite side walls integral along fold lines with said bottom and adapted when folded to be generally normal to said bottom, said side walls each having a single thickness free edge;

sides of said carton when erected being formed only by said opposite side walls;

opposite end walls each integral with said bottom and one of said top parts and adapted when folded to engage ends of said side walls;

said top parts and said end walls being wider than the width of said bottom between said side walls, so as to extend therebeyond when folded into carton form with the edges of said top parts generally closely adjacent to one another, and said top parts being supported by said free edges of said single thickness side walls;

means formed on said top parts and said side walls for securing the carton in assembled condition.

6. A carton as recited in claim 5, formed of a single sheet of material.

* * * * *